US005713159A

United States Patent [19]

Schmidt

[11] Patent Number: 5,713,159

[45] Date of Patent: Feb. 3, 1998

[54] MULTI PART PLASTIC LINEAL

[75] Inventor: Helmut Schmidt, Unionville, Canada

[73] Assignee: Dominion Plastics Inc., Woodbridge, Canada

[21] Appl. No.: 572,861

[22] Filed: Dec. 14, 1995

[51] Int. Cl.[6] ..... E04B 1/08

[52] U.S. Cl. ..... 52/98; 52/204.53; 52/204.71

[58] Field of Search ..... 52/98, 100, 730.1, 52/730.3, 730.6, 731.7, 732.2, 204.53, 204.62, 204.64, 204.71; 264/239, 240; 72/253.1, 254, 255

[56] References Cited

U.S. PATENT DOCUMENTS

| | | | |
|---|---|---|---|
| 2,883,717 | 4/1959 | Arno | 52/204.62 X |
| 4,662,553 | 5/1987 | Grosjean | 52/100 X |
| 4,837,991 | 6/1989 | Shaw | 52/98 |
| 5,157,881 | 10/1992 | Tashman | 52/98 |
| 5,184,494 | 2/1993 | Krude | 72/254 |
| 5,365,650 | 11/1994 | Smith et al. | 72/254 X |

FOREIGN PATENT DOCUMENTS

| | | | |
|---|---|---|---|
| 282724 | 12/1987 | Japan | 72/254 |

*Primary Examiner*—Carl D. Friedman
*Assistant Examiner*—Beth A. Aubrey

[57] ABSTRACT

A lineal of plastic material comprises multiple components extruded as a single piece and secured to one another by at least one wall formed in the lineal. One of the components is provided with a recess and another of the components has a leg which, upon separation of the components at the wall, fits into the recess of the one component to provide a mated component system.

5 Claims, 1 Drawing Sheet

MULTI PART PLASTIC LINEAL

FIELD OF THE INVENTION

The present invention relates to the formation of multiple components from a single lineal of plastic material.

BACKGROUND OF THE INVENTION

In systems such as panel securing systems using extruded snap together components it has been necessary, according to conventional practise to extrude the components separately from one another. This often makes it difficult to guarantee accuracy of the fit between the components and further requires an inventory of each of the components.

SUMMARY OF THE INVENTION

The present invention provides a lineal of plastic material comprising multiple components extruded as a single piece and secured to one another by at least one thin wall formed in the lineal. One of the components is provided with a recess and the other of the components is provided with a leg which, upon separation of the components at the wall, fits into the recess of the one component for mating the components with one another.

The components can be used for example as snap together panel supports which are particularly accurate in their fitting because they are extruded as single integrated profile. In addition, this reduces inventory requirement because, rather than having to handle two separate pieces of inventory, the components, prior to separation, are held together with one another as a single unit.

DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
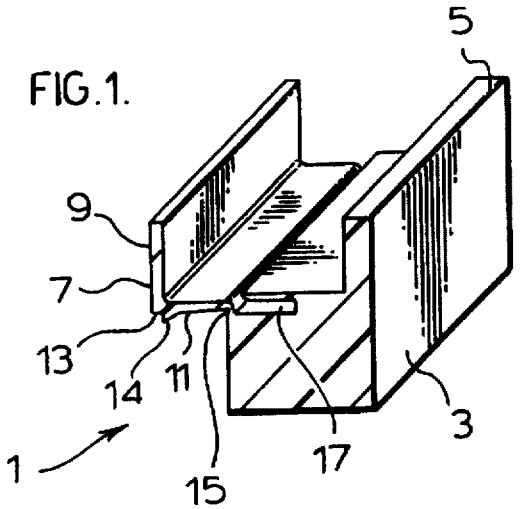
FIG. 1 is a perspective view of a section of a lineal having multiple components integrated with one another by a frangible wall.

FIG. 1 shows a short section of a lineal of plastic material generally indicated at 1. This lineal which is made in a single extrusion process comprises a first component 3 and a second component 7 held together with one another by a thin wall of material 15 within the profile. Wall 15 provides for integration of the over all profile.

In the particular example shown in FIG. 1, profile 1 is preferably made from a thermoplastic material, e.g. vinyl or the like and the two components are ultimately used as a panel frame. Component 3 includes panel support portion 5 and component 7 includes panel support portion 9.

Component 7 further includes a leg 11 which is secured at one end of the leg by the wall 15 directly in alignment with a recess 17 provided in component 3. A small step 14 is provided at the other end of leg 11 to define a notch 13 behind the step 14.

Figure 2:
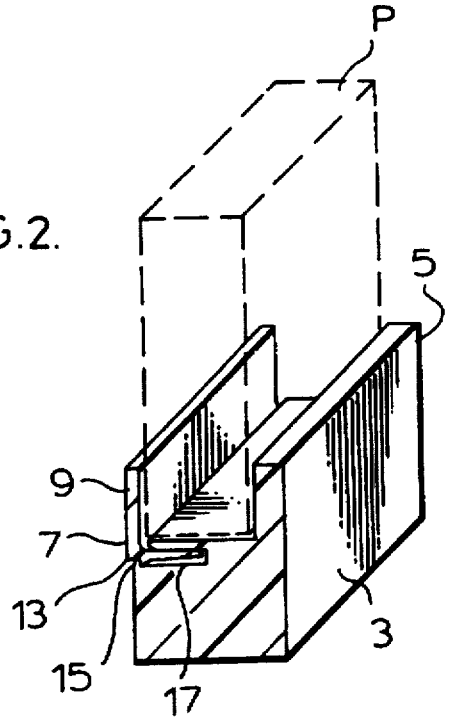
FIG. 2 is a further perspective view of the components of FIG. 1 after separation at the thin wall and when mated with one another to opposite sides of a panel.

As earlier noted, FIG. 1 shows the over all profile as it is extruded. Wall 15, which is the thinnest area of material in the profile, defines an easily separated region between components 3 and 7. Therefore, the two components can be separated from one another by, for example, cutting wall 15. The two components can then be used for supporting a panel such as panel P shown in FIG. 2 of the drawings. In order to perform this function, the leg 11 of the retaining component 7 is simply slid into the recess 17 of the framing component 3. The two panel supports 5 and 9 of the respective components fit to either side of the panel as shown in FIG. 2 of the drawings. As can also be seen in FIG. 2, part of the wall 15 remains at the mouth of the recess 17 and the step 14 effectively cams over this remaining wall portion which then locks in notch 13 to provide an effective interlock to hold the leg 11 in the recess 17. As will be appreciated, the inherent flexibility of the thermoplastic material eases the interfitting of the two components with one another.

As will be seen in comparing FIGS. 1 and 2 of the drawings, a retention groove is defined between the two panel supports 5 and 9 of components 3 and 7. The only difference between the configurations of FIGS. 1 and 2 is that after wall 15 has been cut, the retention groove substantially narrows when the two components are interlocked as shown in FIG. 2.

Figure 3:
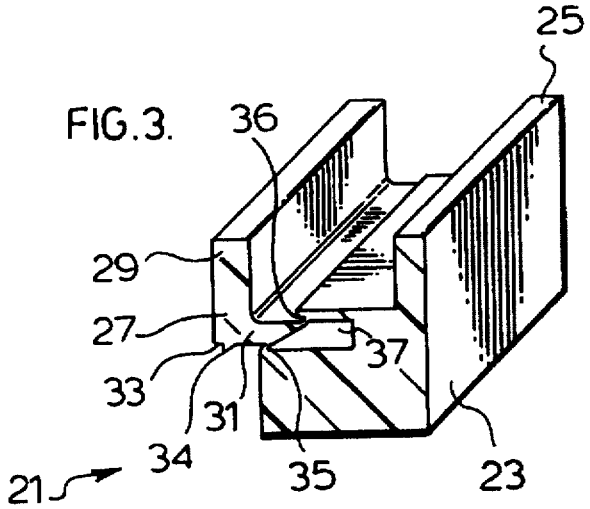
FIG. 3 is a perspective view of a further multi component integrated profile in which the components are secured by multiple thin walls.
Figure 4:
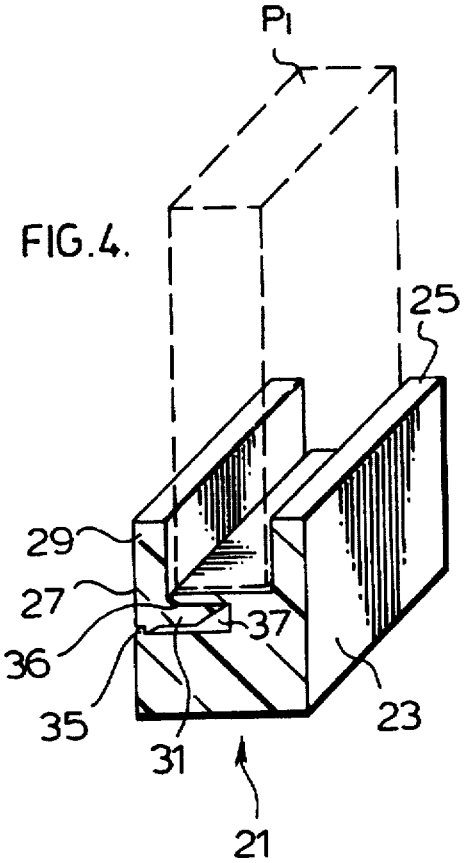
FIG. 4 is a perspective view of the components of FIG. 1 when separated at the thin walls and mated with one another to opposite sides of a panel.

FIG. 3 shows a further integrated multi component extruded profile while FIG. 4 shows the components from the profile of FIG. 3 after being separated and then mated with one another to opposite sides of a panel P1. The difference between this construction and that shown in FIG. 1 is that in the FIG. 3 profile, the two components are integrated at more than a single connection.

The single connection system of FIGS. 1 and 2 is best suited for mechanical or bonded frame assemblies, while the multiconnection system of FIGS. 3 and 4 lends itself to welded frame assemblies.

More particularly, FIG. 3 shows a profile 21 comprising a framing component 23 and a retaining component 27. Component 23 includes a panel support 25 which is parallel to and spaced from a panel support 29 of component 27. Component 27 includes a leg 31 which is secured by two thin wall regions 35 and 36 to the component 23 directly in line with a recess 37 of the framing component.

Component 27 is provided with a small step 34 along the bottom side of leg 31 with a notch 33 behind the step 34.

Components 23 and 27 are again separated from one another by cutting or otherwise breaking through the two thin wall regions 35 and 36. This allows the leg 31 of component 27 to simply be slid into the recess 37 of component 23. Part of the wall 35 remains at the mouth of the recess 37 and the small step 34 of leg 31 cams over and locks to the inside of this remaining wall region as best seen in FIG. 4 of the drawings.

As will be understood from the above, this invention has particular application for extruded profiles in which the components are designed to connect to each other by a snap or a slide fitting. The extrusion of multiple components in a single extrusion step and then separating the components for assembly into one or more component frames ensures precise relationships between the specific profiles. Not only does this enhance the fitting of the components, but in addition, improves the aesthetics because, as a result of the precise relationship between the components, the corner and linear fit is uniform after the components are mated with one another.

In addition, the precise relationships of specific profile components allows for the pre-assembly of the components into rigid frames contributing to over all rigidity of a complete assembly after mating of the individual components.

As noted above, the integration of multiple components into a single lineal or profile enables extruding, handling and storing of fewer profiles therefore providing substantial cost savings over conventional inventory systems. In addition, the integrated profiles can be welded into complete frames and later finished adding further to labour savings.

The conventional method of mating individual components in a snap or slide in fashion onto an assembled frame requires a multitude of manual handling operations. In accordance with the present invention, the separation of the integrated extrusions and their follow up assembly into frames significantly diminishes the number of separate parts destined for mating thereby facilitating use of automated equipment in the manufacturing of the mated assemblies.

In the detailed description above, reference is made to lineals incorporating first and second integrated components. However, it is to be appreciated that more than two cooperative components can be integrated in a single lineal. Those components may be used for various different functions including the panel mounting function described with respect to FIGS. 1 through 4 of the drawings. The term panel covers many different types of structures including glazed panels used in windows, doors, sky lights, solariums, green houses, etc. It also covers panel frames such as those used as insulating or structural building elements, decorative panel, picture frames, etc. Separation elements such as fence panels, optical or ventilation louvers can also be easily secured using the mating component system of the present invention.

Although various preferred embodiments of the present invention have been described in detail, it will be appreciated by those skilled in the art, that variations may be made without departing from the spirit of the invention or the scope of the appended claims.

The embodiments of the invention in which an exclusive property or privilege is claimed are defined as follows:

1. A lineal of plastic material comprising at least first and second panel securing components extruded as a single piece, said first component having a recess therein and said second component having a leg secured to said first component by at least one wall in said material, said components interlocking with one another to form a panel receiving groove after separating said components at said wall with said leg of said second component secured in said recess of said first component.

2. A lineal of plastic material as claimed in claim 1, wherein said wall is formed at said recess of said first component and after separating said components part of said wall remains at and provides a grip which holds said leg in said recess.

3. A lineal as claimed in claim 1, wherein said first and second components are secured together by two thin walls in said material.

4. A lineal as claimed in claim 1, wherein said components include panel supports which are parallel and spaced from one another both when said components are secured and separated from one another, the spacing between said panel supports being greater when said components are secured than when said components are separated at said wall from one another.

5. A lineal as claimed in claim 2, wherein said second component includes a small step which interlocks with said grip on said first component.

* * * * *